US006085994A

United States Patent [19]

Zink

[11] Patent Number: 6,085,994

[45] Date of Patent: Jul. 11, 2000

[54] CABLE SUPPORTED ROTARY MULTI-JET NOZZLE

[75] Inventor: Gerald P. Zink, Durango, Colo.

[73] Assignee: Stoneage, Inc., Durango, Colo.

[21] Appl. No.: 09/378,300

[22] Filed: Aug. 20, 1999

[51] Int. Cl.[7] ..... B05B 3/00

[52] U.S. Cl. ..... 239/227; 239/252; 239/258

[58] Field of Search ..... 239/225.1, 227, 239/251, 252, 253, 258, 255, 264; 134/172, 198

[56] References Cited

U.S. PATENT DOCUMENTS

| | | | |
|---|---|---|---|
| 2,865,672 | 12/1958 | Guinard | 239/225.1 |
| 3,074,098 | 1/1963 | Downing | 134/172 |
| 3,255,970 | 6/1966 | Saad | 239/227 |
| 3,326,468 | 6/1967 | Bristow et al. | 239/227 |
| 3,931,930 | 1/1976 | Waldrum | 239/225.1 |
| 4,960,159 | 10/1990 | Vadakin et al. | 134/172 |
| 5,169,069 | 12/1992 | Rucker et al. | 239/227 |
| 5,947,387 | 9/1999 | Zink et al. | 239/227 |

*Primary Examiner*—Andres Kashnikow
*Assistant Examiner*—Lisa Ann Douglas
*Attorney, Agent, or Firm*—Maxwell C. Freudenberg; Keaton L. Freudenberg

[57] ABSTRACT

A multiple nozzle swivel assembly for mounting on a cable support stretched across the interior of a chamber to be scrubbed with high velocity jet streams or stretched along an array of objects to be cleaned as the swivel assembly traverses the cable from one end to the other. The cable passes through a coaxial bore in an elongated shaft carrying both a relatively stationary an input member for supply of high pressure liquid to the assembly and a rotatable output nozzle-carrying spray head member. The shaft is monolithic with multiple angularly spaced bores around the central bore and parallel thereto and sealed from the central bore carry high pressure liquid from the input member to the output spray head member with very low drag bearings and liquid seals being provided between relatively rotating liquid carrying components. The assembly includes multi-directioned nozzle elements on a rotatable spray head. Positive drive to rotate the spray head is achieved with a rotational speed controlling motor. With the aid of low drag forces at bearings and rotating liquid seals, the spray head may be self rotated by reaction forces of jet streams from the head. The assembly may be pulled along the cable by an auxiliary device or it may be self-propelled along the cable by reaction of jet streams. For pulling the assembly along the cable a swivelled pulling bail is attached to the shaft.

21 Claims, 9 Drawing Sheets

CABLE SUPPORTED ROTARY MULTI-JET NOZZLE

This invention relates to a high pressure liquid rotary swivel nozzle assembly device intended to be supported by a small diameter cable spanning interior walls of a chamber, or extending along a spacial area in which may be located a variety of objects, to be cleaned by high pressure liquid jet streams issuing in continuously varying directions from multiple jet nozzle elements of the device as the device is propelled along the cable support. The device is particularly useful for cleaning the interior of large cylindrical chambers where the cable support extends coaxially of the chamber between its opposite end walls with the device moving from one end wall to the other during a cleaning operation.

BACKGROUND OF THE INVENTION

It is frequently necessary to remove layers of particulates or other coatings which have collected on surfaces of an extended array of objects or on the interior walls of industrial chambers, transportation vessels or other large containers by means of high pressure liquid jet streams moved to scan and scrub with high pressure liquid jet streams all exposed and interior surfaces of the various structures. Often it is inconvenient or impossible to position and move bulky spray cleaning equipment along or within such objects or structures because of the nature of access around an array of objects, or access through openings, or around interior interfering beams, posts or other structural obstructions so that cable carried spraying devices become practical for cleaning. Also a cable carried movable multi-jet cleaning tool with rotating jets angled in forward and backward directions may provide optimum cleaning of opposite sides of and behind such obstructions.

DESCRIPTION OF PRIOR ART

Rotary spray devices for cleaning large chamber interiors are disclosed in U.S. Pat. No. 4,690,159 and references cited or discussed therein. This patent discloses an air-motor driven rotary high pressure fluid nozzle device carried by a cable support.

SUMMARY OF THE INVENTION

It is an object of this invention to provide a compact cable carried rotary nozzle assembly that lends itself to use of a variety of spray nozzle elements of lengths without interference of spray patterns therefrom by any structural portions of the nozzle assembly or by portions of objects being cleaned.

Another object of this invention is to provide a compact cable carried rotary nozzle assembly that can be self-propelled along the cable by jet stream reaction and lends itself to use of a variety of oppositely balanced spray nozzle elements of maximum length without interference of spray patterns therefrom by any structural portions of the nozzle assembly. Another object of this invention is to provide a compact cable carried rotary nozzle assembly that can be self-rotating by jet stream reaction while being propelled along the cable.

Another object of the invention is to provide in a compact cable carried rotary nozzle assembly an improved low friction rotary bearing support between a relatively stationary high pressure liquid input body member and a rotatable multi-nozzle spray head member.

Another object of the invention is to provide in a compact cable carried rotary nozzle assembly an improved long wearing low drag high pressure liquid sealing structure between a relatively stationary high pressure liquid input body member and a rotatable multi-nozzle spray head member.

Another object of the invention is to provide an improved compact cable carried rotary nozzle assembly that is readily and easily disassembled for inspection, cleaning or replacement of parts and reassembled with minimum tools.

Another object of the invention is to provide an improved shaft structure in a cable carried rotary nozzle assembly having a rotary nozzle carrying shaft with separate axially extending liquid-carrying and cable-accommodating bored passages.

Another object of the invention relates to an improved shaft structure for a cable mounted spray assembly structure utilizing multiple elongated bores in a unitary shaft member as the fluid passage conduits through the shaft.

Another object of the invention is to provide an improved shaft structure for a cable mounted spray assembly having a central cable passage surrounded by a plurality of uniformly angularly spaced and symmetrically spaced individual liquid passage bores for conducting high pressure liquid between an input body member and a rotatable spray head member.

Another object of the invention is to provide an improved liquid sealing structure in the nozzle carrying shaft of a cable carried rotary nozzle assembly having a rotary nozzle carrying shaft with separate axially extending liquid-carrying and cable-accommodating shaft passages.

Another object of the invention is to provide an improved shaft-supported pulling eye assembly for a cable carried rotary nozzle assembly having a rotary nozzle carrying shaft with separate axially extending liquid-carrying and cable-accommodating passages.

Another object of the invention is to provide an improved cable carried rotary nozzle assembly which lends itself to fast setup along an array of objects to be cleaned or within an enclosed area having limited access in the vicinity of surfaces to be cleaned.

The present invention provides a high pressure liquid swivel nozzle assembly adapted for sliding movement along a small diameter cable support, or similar elongated support, and for spraying multiple high pressure liquid streams outwardly in continuously changing directions relative to the cable support. An elongated main shaft of the nozzle assembly, rotatably carried by the cable and having a longitudinal axis, carries a relatively stationary liquid input body member and an output liquid spray head member rotatable with the shaft. The cable passes through a central axial passage in the shaft. The shaft has multiple internal liquid passage means extending longitudinally within the shaft in isolated relationship to a central axial passage for the cable.

Each of the input body member and the nozzle carrying spray head member encircles the shaft and includes means sealed with respect to the shaft for defining with the shaft a respective annular plenum chamber around the shaft with each plenum chamber communicating with the liquid passage means in the shaft to enable flow of high pressure liquid from the body member to the nozzle carrying spray head member.

At one plenum chamber between the rotary shaft and a relatively rotatable member encircling the shaft the sealing structure comprises symmetrical opposed stacks of sealing elements including abutting but relatively movable flat radially extending surfaces forming a set of axially engaged face seals and radially engaged cylindrical seals at opposite ends of the plenum chamber.

The invention provides the arrangement of face seals and cylindrical seals at opposite ends of the plenum chamber at an interface between two relatively movable members for sealing of high pressure liquid within the plenum chamber and for helping to provide low drag during relative rotation of the two members.

Sealed radial ball bearing means support the input body member relative to the shaft enabling the shaft to rotate within the body member while the latter is held against rotation by liquid input hoses attached to the input body member and by non-rotating portions of an air motor assembly which rotates the shaft. The output liquid spray head member is secured to the rotatable shaft.

Hose means couple a high pressure liquid source to the input body member. Multiple hoses are preferably used to assure high volume liquid supply to the spray nozzle assembly. Liquid supply hoses are preferably connected to a lower portion of the spray nozzle assembly to improve stability of the assembly and minimize rotation of the assembly relative to its supporting cable during a cleaning operation. Multiple nozzle elements are carried by the spray head member for creating multiple high velocity jet streams when high pressure liquid is supplied to the body member, The ball bearing means facilitate rotating the spray head member relative to the body member to continuously change the directions of the high velocity jet streams during operation of the nozzle assembly.

Mechanical connection means between the non-rotating housing of the air motor and the liquid input body member help to prevent rotation of the liquid input body member relative to the support cable during operational movement of the swivel assembly along the cable.

A dynamic sealing means is provided at each end of the plenum chamber at the liquid input member forming a high pressure liquid seal between the shaft and the input body member to prevent escape of high pressure liquid.

Each such sealing means comprises spaced sealing rings at opposite sides of the plenum chamber at the liquid input member, annular wear resistant sealing disks engaging the sealing rings, and annular plastic sealing elements in axial facial sealing engagement with the disks and in radial sealing engagement with an inwardly facing cylindrical surface of the liquid input member.

The sealing rings are located between the ball bearing means which support the shaft in the input body member and are sealed with respect to the shaft. The sealing rings have opposed parallel flat annular faces closely encircling the shaft. The input body member has a pair of inner annular surfaces opposite the flat annular faces of the sealing rings. These sets of opposed faces define a pair of annular spaces for retaining the sealing disks and the plastic sealing elements in stacked pairs with the wear resistant disks abutting the flat annular faces of the rings.

The air motor has an air driven vane rotor connected to a worm gear which drives an annular output gear member which is keyed to an extension portion of the main shaft of the nozzle assembly.

In lieu of a speed controlled air motor drive for the nozzle assembly, speed controlled hydraulic or electric motors may be substituted.

In lieu of an externally powered separate motor drive with an appropriate speed control mechanism for rotating the shaft , the shaft may be rotated by reaction forces of jet streams from the sets of spray nozzles appropriately oriented. Damping or retarding means may be connected between the shaft an a relatively stationary structure to limit rotating speed of the shaft to an efficient speed.

DESCRIPTION OF PREFERRED EMBODIMENT

Figure 3:
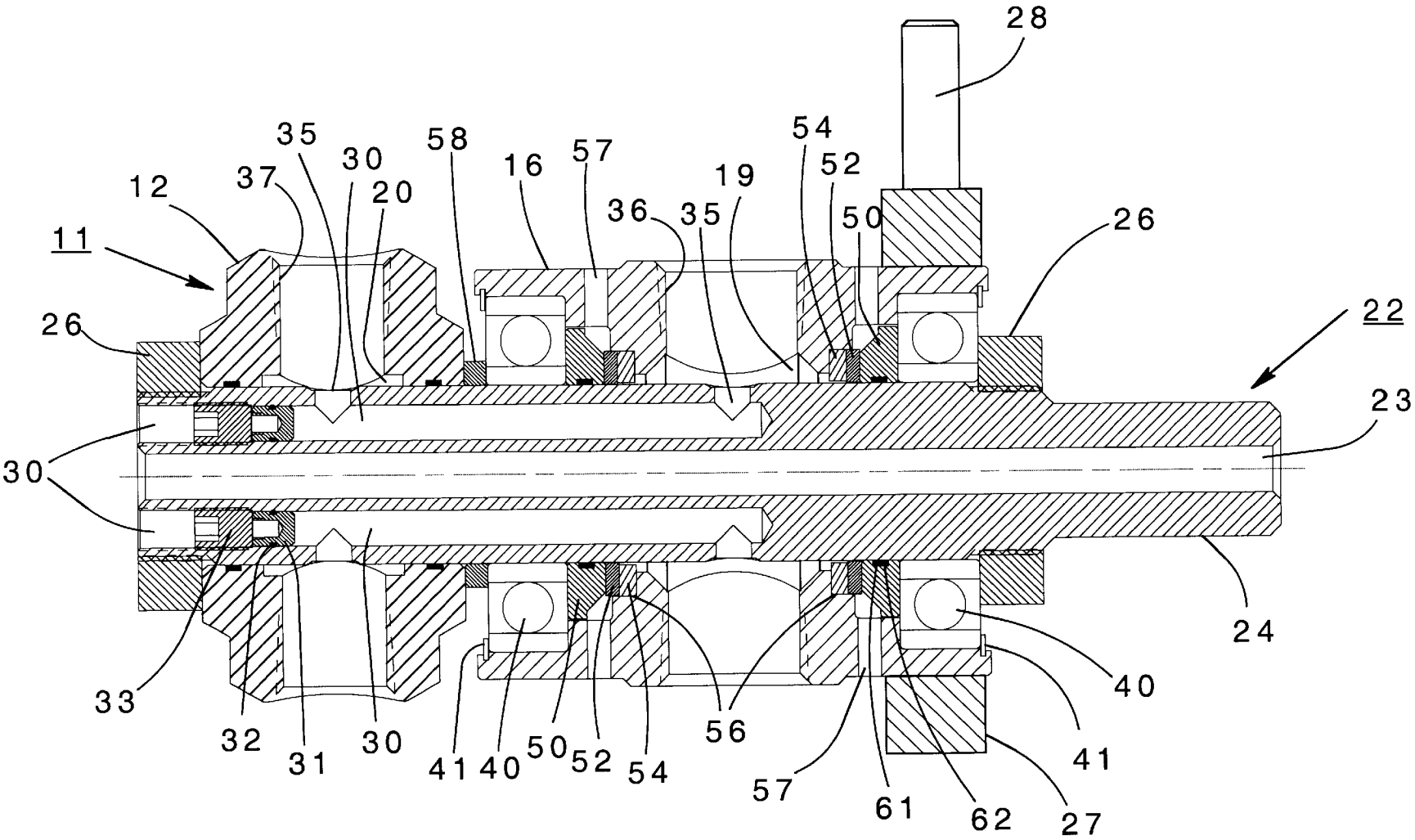
FIG. 3 is a section of a subassembly of FIG. 1 showing a shaft with longitudinal cable and high pressure liquid passages, a liquid input member rotatably carrying the shaft, a spray nozzle carrying head member carried by the shaft, and details of bearings and liquid seals between the input and head members and the shaft.
Figure 4:
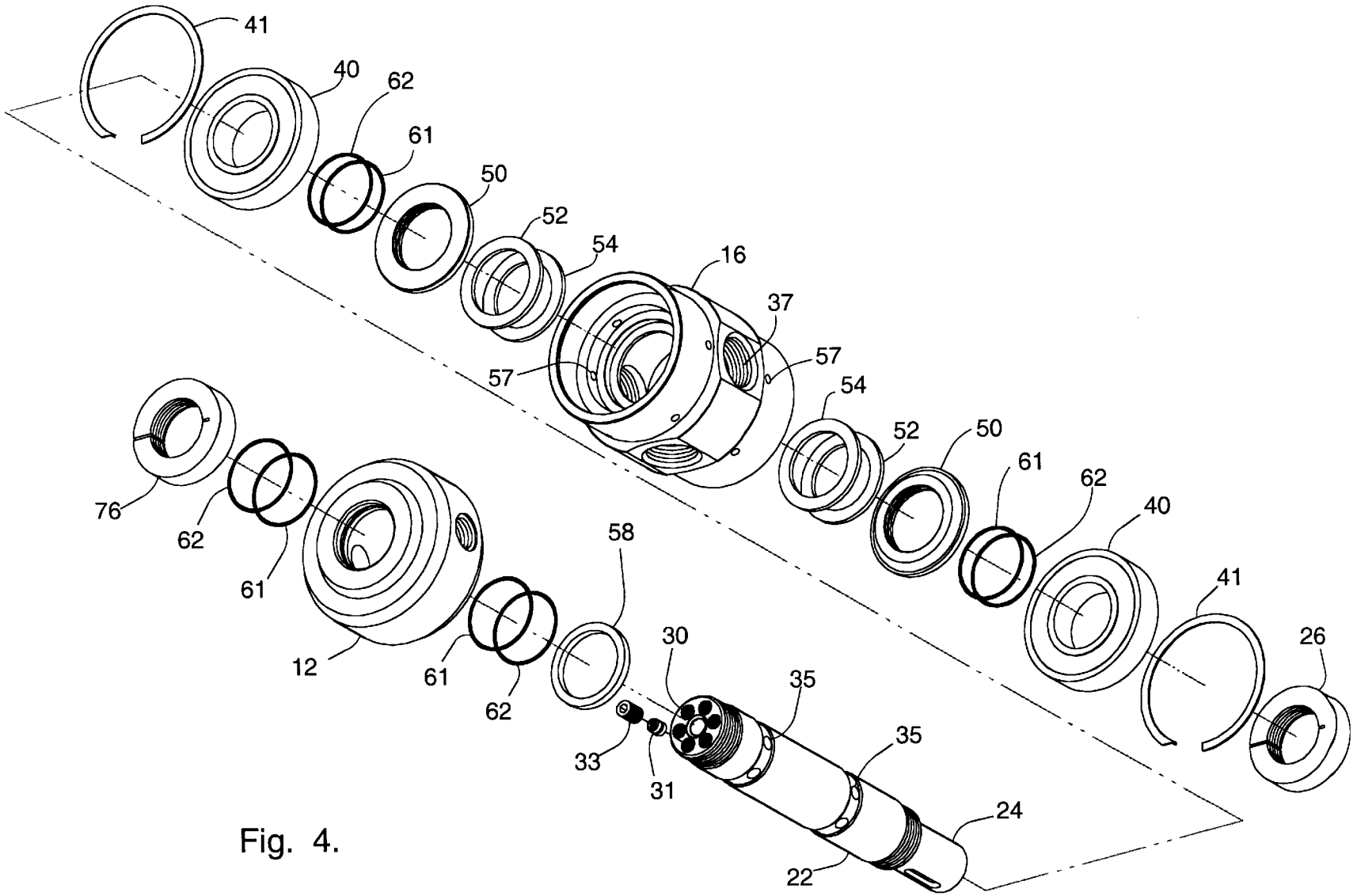
FIG. 4 is an exploded view of the components of the assembly of FIG. 3.

The present invention provides a high pressure liquid swivel nozzle assembly 10 adapted for sliding movement along a small diameter support cable 14, or similar elongated support, and having multiple sets of two or more nozzle element pairs, such as A—A, B—B and C—C, on a rotatable spray head member 12 for spraying multiple high velocity liquid streams outwardly in continuously changing directions relative to the cable support. FIGS. 3–4 show an elongated main shaft 22 of a nozzle subassembly 11 (FIG. 3), to be rotatably carried by the cable 14 and having a longitudinal axis. The shaft 22 is encircled and rotatably carried by a relatively stationary liquid input body member 16. The output liquid spray head member 12 is rotatable with the shaft 22. The shaft 22 is rotated relative to the body member 16 by means of an air motor 18. The air motor 18 has a conventional air driven vane rotor connected to a worm gear which drives an annular output member 25 which is keyed to an extension portion 24 of the main shaft 22 of the nozzle subassembly 11 seen in FIG. 3.

The cable 14 passes through a central axial longitudinal passage 23 in the shaft. The shaft 22 has internal liquid passage means formed by six bores 30 extending longitudinally within the shaft in isolated relationship to the central axial passage 23 for the cable.

Each of the input body member 16 and the spray head member 12 encircles the shaft 22 and includes means sealed with respect to the shaft 22 for defining with the shaft respective annular plenum chambers 19 and 20 around the shaft with each plenum chamber communicating with the six axially extending uniformly angularly spaced liquid passage bores 30 in the shaft to enable flow of high pressure liquid from the body member 16 to the heat member 12. The bores 30 in the shaft 22 are sealed at their outer ends by means of plugs 31 having O-rings 32 in annular grooves in their outer surfaces. The outer ends of these plugs 31 may be internally threaded to facilitate removal with a threaded tool. The plugs 31 are secured in place by set screws 33 recessed in outer threaded ends of the bores 30 at one end of the shaft 22. Radial or lateral passages 35 provide means for connecting opposite ends of the bores 30 with the respective plenum chambers 19 and 20.

It will be seen from FIG. 3 that each of the bore passages 23 and 30 has an outer wall structure extending essentially the length of the shaft portion between the plenum chambers 19 and 20. These walls are part of the monolithic structure of the shaft and the walls of each passage are connected to other passage walls along their lengths between the plenum chambers.

Throughout the axial extent of the shaft 22 within the input member 16 and output member 12 and all along the flow passages within the shaft from plenum chamber 19 to plenum chamber 20, and along the extent of the wall of the central axial passage 23 the shaft 22 is a monolithic shaft structure produced by simple precise machining of a round bar stock. There are no high pressure liquid seals along the internal high pressure liquid flow passages. The only seals used in the shaft structure are the small O-rings seals 32 around the plugs 31 and these O-ring seals 32 are in the static plugs 31 backed up by the set screws 33 and not subject to being blown out by high pressure liquid in the bores 30.

Sealed radial ball bearing means 40 support the shaft 22 relative to the stationary input body member 16. During assembly and disassembly of the structure of FIG. 3, the outer races of bearings 40 are retained in annular recesses at opposite ends of the input body member 16 by means of removable spring retaining rings 41 snapped into grooves at outer ends of the respective annular recesses. The bearings 40 enable the shaft 22 to be rotated within the body member 16 while the latter is held against rotation by means including one or more liquid input hoses 17 attached to the input body member 16 in respective threaded sockets 37 and by non-rotating portions of an air motor assembly 18 which rotates the shaft 22. The output liquid spray head member 12 is secured to the shaft in a clamped assembly between collars 26 threaded on opposite ends of the shaft 22. Each collar 26 has a radial slit with an internal clamping screw 27 (FIG. 2) spanning the split to tighten the collar 26 securely after it is threaded onto the shaft 22.

Mechanical connection means comprising the ring 27 clamped to the end of the input body member adjacent the air motor 18 pin 28 extending radially outward from ring 27 and plate 29 between the non-rotating housing of the air motor 18 and the liquid input member help to preventing rotation of the liquid input body member 16 relative to the support cable during operational movement of the swivel nozzle assembly 10 along the cable. The air motor is supplied with pressurized air via an input hose 43. Air is exhausted from the motor 18 at an exhaust muffler 44 attached to the motor. Speed of the air motor 18 is controllable by suitable conventional adjustable valve means (not shown) to control the volume of air supplied to the air motor.

Hose means couple a high pressure liquid source to the input body member 16. Each liquid supply hose 17 is connected to a threaded input connection 36 in body member 16. Multiple hoses 17 are preferably used to assure high volume liquid supply to the input body 16 of the spray assembly 10 . When only one supply hose 17 is used, remaining connections 36 in the input body member 16 are sealed with suitable plugs 36P. The multiple pairs of nozzle elements A—A, B—B and C—C are carried by the head member 12 in respective pairs of threaded sockets 37 for creating multiple high velocity jet streams when high pressure liquid is supplied to the body member 16. The ball bearing means 40 facilitate rotation of the head member 12 and the shaft 22 relative to the body member 16 to continuously change the directions of the nozzle streams during operation of the nozzle assembly.

A dynamic sealing means is provided at each end of the plenum chamber 19 at the liquid input member 16 forming a high pressure liquid seal between the rotating shaft 22 and the stationary input body member 16 to prevent escape of high pressure liquid.

At each end of the plenum chamber 19, and at each side of the set or ring of radial passages 35 supplying liquid from the shaft to plenum chamber 19, there is a high pressure rotary liquid sealing means between the relatively rotating shaft and the body member 16. Each sealing means is formed by a stack of sealing components comprising a sealing ring 50, a flat washer-like annular wear resistant carbide sealing seat disk 52 and a strong tough durable flat washer-like deformable plastic annular sealing element 54. The sealing rings 50 each have a central cylindrical opening closely fitting around and sealed with the shaft 22. The rings 50 have flat parallel annular faces orientated toward the plenum chamber 19. The carbide disks 52 each have flat parallel opposite faces, one of which disk faces abuts the flat face of the respective sealing ring 50. The sealing elements 54 each have flat parallel opposite faces, one of which element faces abuts the flat face of the respective carbide disk 52. The disks 52 and the sealing elements 54 have central cylindrical openings which, during assembly, fit closely around the outer cylindrical surface of the shaft 22 and outer cylindrical peripheral surfaces which are radially confined by respective opposing inwardly facing annular cylindrical wall surfaces of the body member 16. Also, during assembly, the disks 52 and sealing elements are axially confined between respective flat faces of the sealing rings 50 and flat radially extending annular wall surfaces of the body member 16. These confining cylindrical wall surfaces and radially extending wall surfaces of the body member 16 meet at the corners 56, identified in FIG. 3, and together with the flat faces of the respective sealing rings 50 define recesses or spaces around the shaft in which the stacked sets or pairs of a carbide disk 52 and a sealing element 54 are located.

The sealing means structures at each end of the plenum chamber 19 are located between the ball bearing means 40 which support the shaft 22 in the input body member 16. The bearings 40 are individually sealed to protect their internal elements from environmental liquids or other contaminants in the vicinity of the shaft.

During operation of the nozzle assembly 10, high pressure liquid in plenum chamber 19 presses the sealing elements 54 axially away from the center of the plenum chamber 19 and against the disks 52 which are in turn pressed axially against the respective sealing rings 50. The deformable sealing elements 54 not only form a facial seals against the respective sealing seat disks 52 , but also are forced outwardly to form a peripheral cylindrical seals against the inwardly facing annular cylindrical surfaces of the body member near the corners 56 as seen in FIG. 3. The sealing elements 54 are held by the liquid pressure relatively stationary against the cylindrical inner surfaces of the body 16 near the corners 56 whereas the abutting sealing faces of the disks 52 and sealing elements 54 have relative sliding movement while the sealing seat disks 52 and the face rings 50 rotate together in abutting relationship during rotation of the shaft 22.

Weep passages 57 in the input body 16 permit escape to the exterior of the spray assembly of liquid seeping past the dynamic sealing means.

Figure 2:
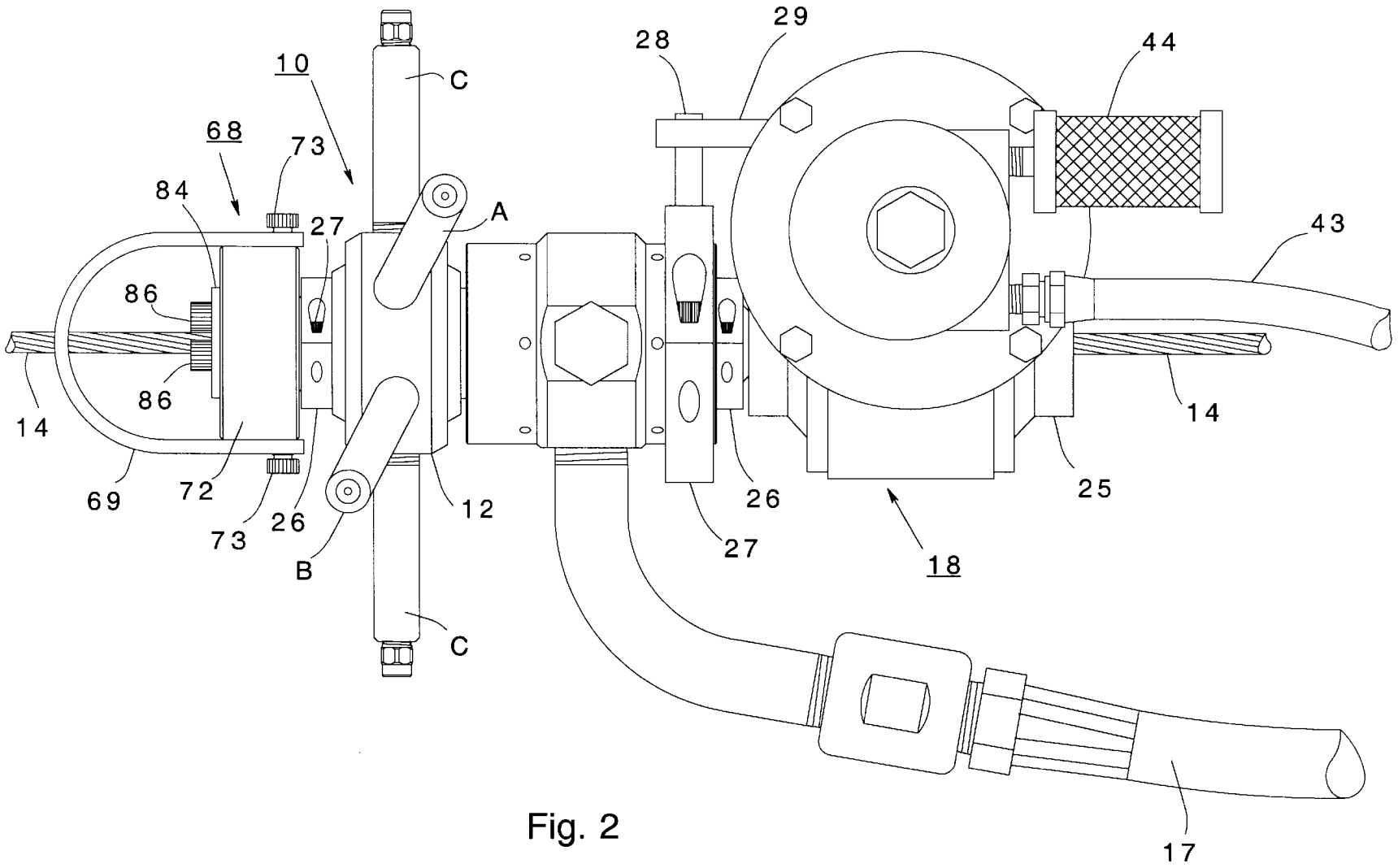
FIG. 2 is a side view of t he cable carried rotary nozzle assembly of FIG. 1.

The collars 26 at opposite ends of the subassembly of FIG. 2, are threaded on the shaft 22 to clamp therebetween the spray head member 12, a spacing ring 58, and the bearing and sealing components held with the input body member 16 by the spring retaining rings 41. These components include the bearings 40 and the sealing components 50, 52 and 54.

At each end of the plenum chamber 19 the face rings 50 have inner cylindrical surfaces closely fitting around the shaft. These surfaces have grooves of sufficient axial extent to each accommodate O-ring sets comprising a primary O-ring seal 61 and a backup O-ring seal 62 to prevent escape along the shaft of high pressure liquid in the plenum chamber 19. Similarly, at each end of the plenum chamber 20 the head 12 has inner cylindrical surfaces closely fitting around the shaft and provided with like sets of primary and backup O-ring seals 60 and 61. The primary seals of each set are nearest the respective plenum chamber.

Figure 1:
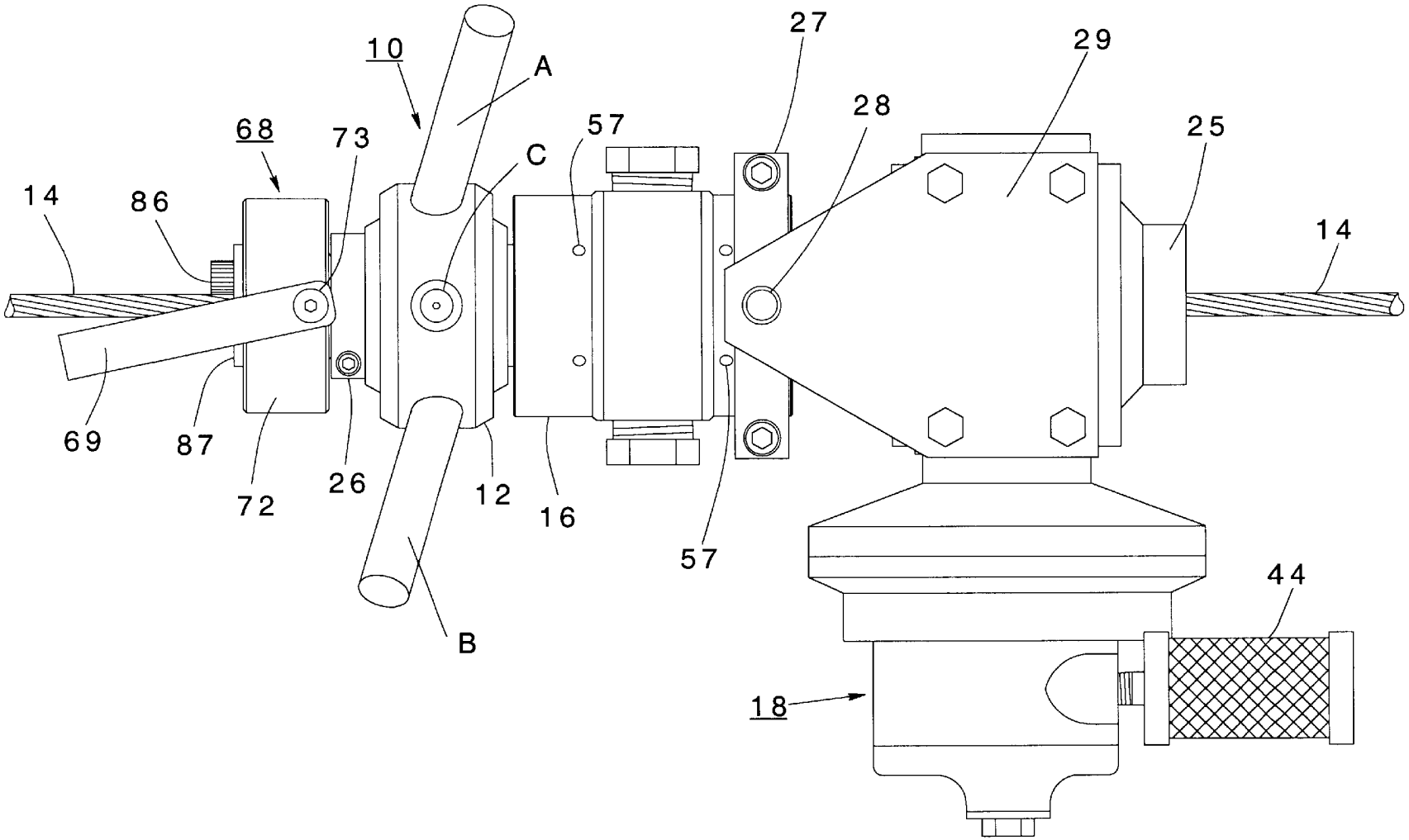
FIG. 1 is a top view of a cable carried rotary nozzle assembly using a speed controlled air motor for nozzle rotation.
Figure 5:
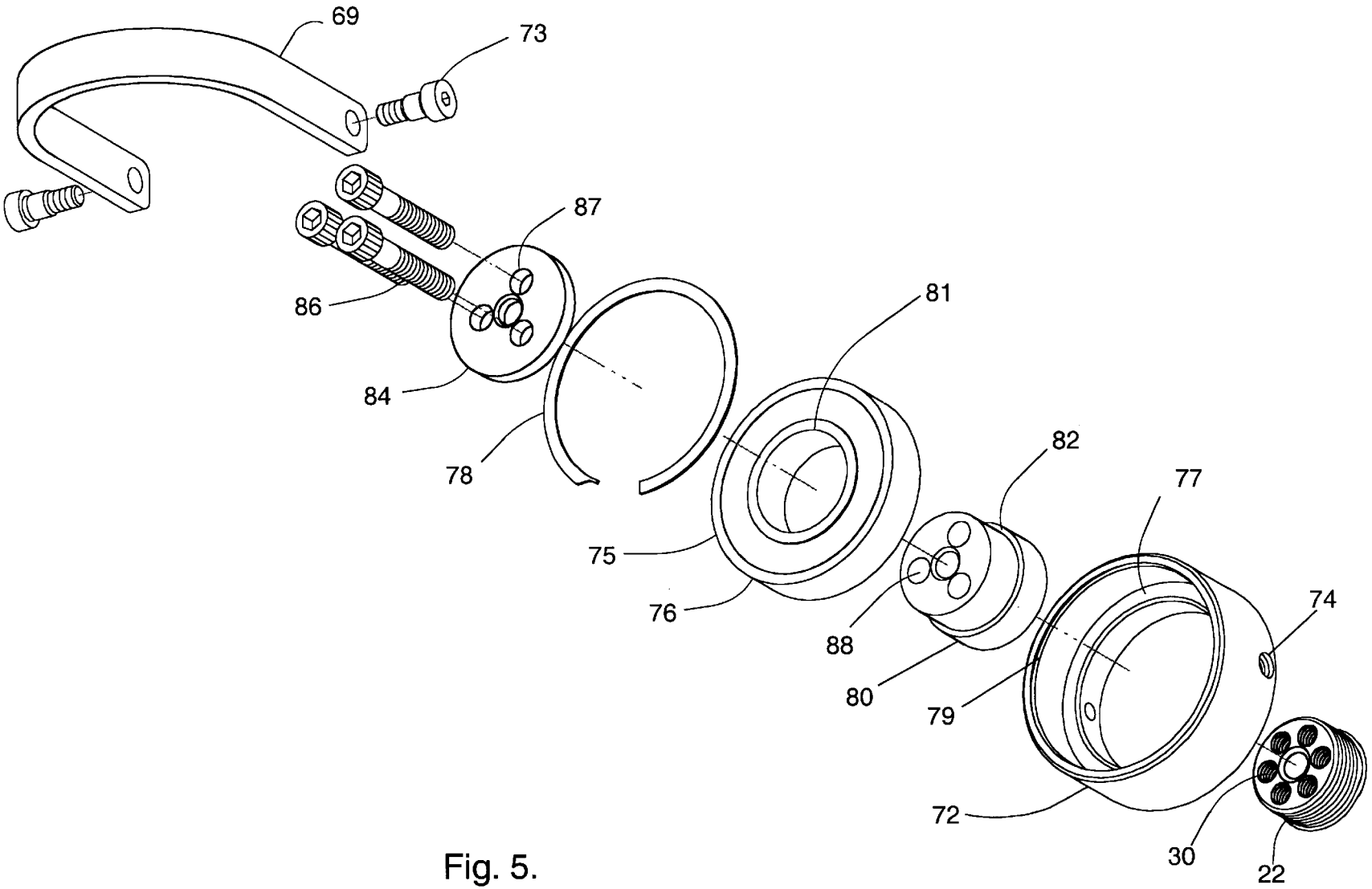
FIG. 5 is an exploded view of a pulling eye subassembly forming part of the assembly of FIGS. 1 and 2 for attachment of a pulling lanyard at the left end of the assembly.

A swivel pulling eye subassembly 68, with a bail member 69 for attachment of a suitable pull cable and a pull cable attaching ring, for pulling the nozzle assembly 10 along the cable 14 is shown attached to the nozzle assembly 10 in FIGS. 1 and 2. The components of this swivel subassembly 68 are shown in the exploded view of FIG. 5.

The bail 69 is swingably mounted on an annular housing member 72 by means of shouldered bolts 73 threaded in holes 74 in the housing 72. An outer race 75 of a sealed radial ball bearing 76 is retained against an internal shoulder 77 in housing 72 by means of a spring retaining ring 78 snapped into an annular groove 79 in housing 72.

A shouldered cylindrical spacer 80 has an end face (hidden in FIG. 5) for engaging the end of shaft 22 and/or collar 26 at the end of the shaft 22 containing the bores 30. A reduced diameter portion of the spacer 80 fits closely within the inner race 81 of bearing 76 and race 81 is held against spacer shoulder 82 by a washer 84. The washer 84, inner race 81 and spacer 80 are secured to the shaft 22 by means of three bolts 86 which pass through uniformly angularly spaced holes 87 and 88 in washer 84 and spacer 80, respectively. The bolts 86 are threaded into the outer ends of three alternate bores 30 after the set screws 33 are threaded into and recessed in respective bores 30 as seen in FIG. 3.

Figure 6:
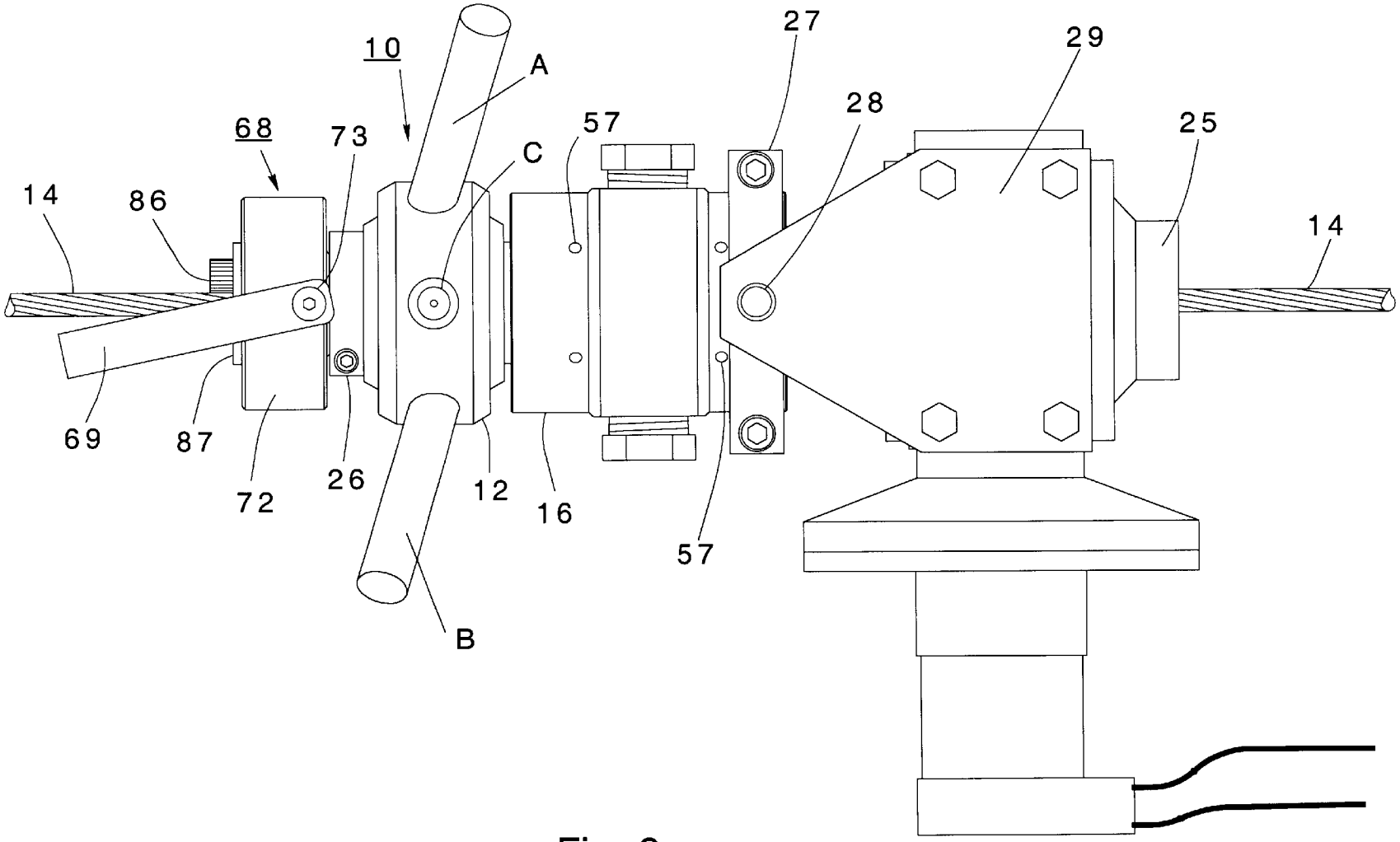
FIG. 6 is a side view similar to FIG. 1 of an alternative embodiment of a cable carried rotary nozzle assembly using a speed controlled hydraulic motor for nozzle rotation.

In lieu of the fluid operated air motor 18, a hydraulic liquid operated fluid motor may be used with suitable hydraulic fluid lines providing supply and exhaust connections to the motor. Such an arrangement has an advantage of enabling recirculation of the operating fluid without exhausting the motor operating fluid into the chamber where cleaning is taking place. FIG. 6 shows a rotary high pressure spray nozzle assembly having essentially the same components as the assembly of FIG. 1 except for the use of a hydraulic motor 90 for rotating the shaft 22 of the subassembly of FIG. 3. The hydraulic motor has supply and discharge lines 91 and 92 for supplying appropriate hydraulic fluid pressure and volume to achieve a desired motor speed for rotating the shaft 22 at a desired speed.in a manner well known in the art.

Figure 7:
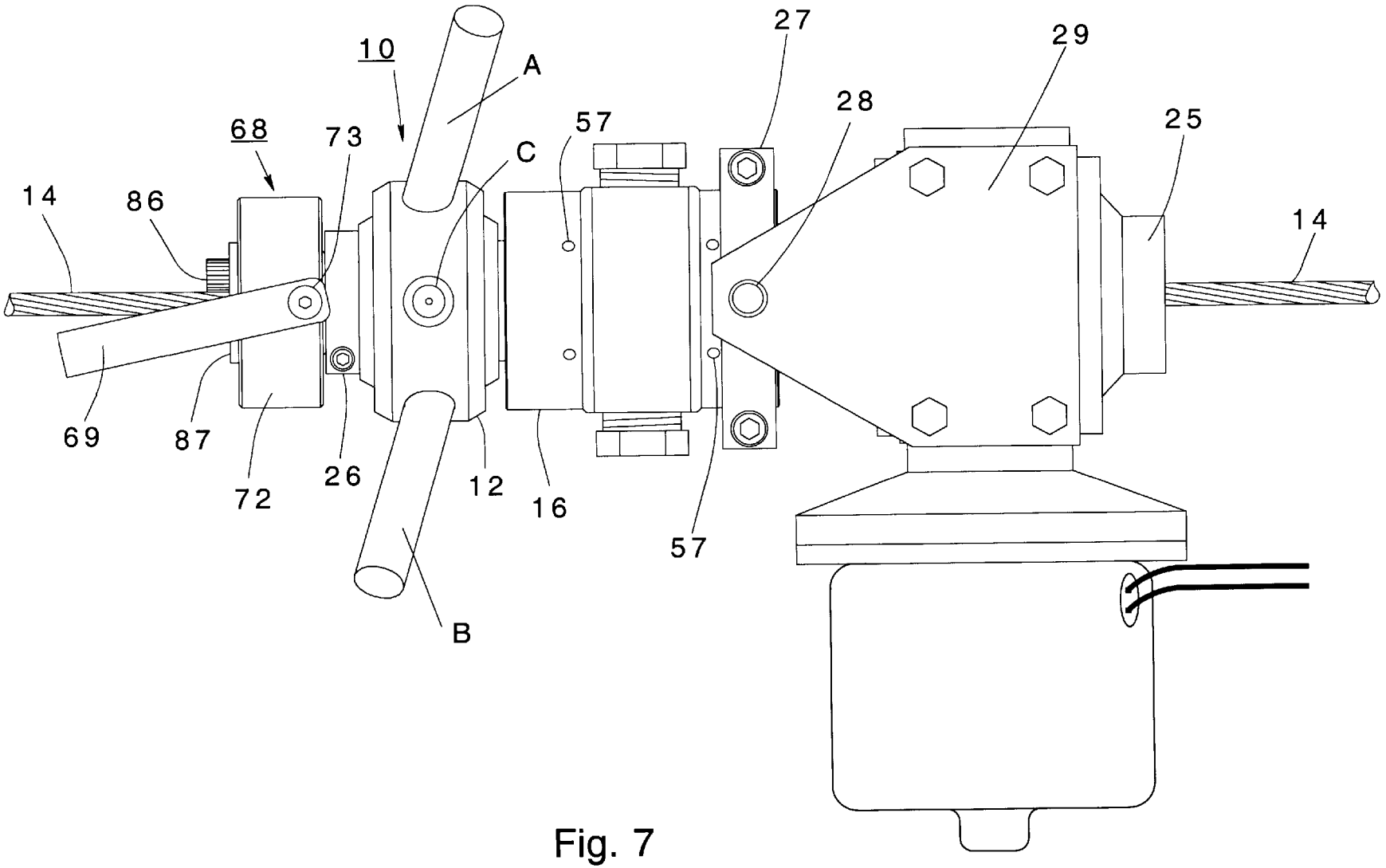
FIG. 7 is a side view similar to FIG. 6 of an alternative embodiment of a cable carried rotary nozzle assembly using a speed controlled electric motor for nozzle rotation.

Similarly, in lieu of air or hydraulic motors, the shaft may be rotated by an electric motor 93 as seen in FIG. 7. Suitable electric cables 94 and 95 supply controlled power to the motor to rotate the shaft 22 at a desired speed.in a manner well known in the art.

In lieu of an externally powered separate motor drive with an appropriate speed control mechanism for rotating the shaft 22, the shaft may be rotated by reaction forces of jet streams from the sets of spray nozzles appropriately oriented. Damping or retarding means may be connected between the shaft an a relatively stationary structure to limit rotating speed of the shaft to an acceptable speed . Preferable speeds may be in the range of 5 to 200 rpm dependent on the geometry and size of the spray assembly. Well known retarders for such purpose include viscous damping devices, eddy current devices, permanent magnet retarders, rotatably driven hydraulic retarders with adjustable speed regulating orifices and speed regulating friction devices.

Figure 8:
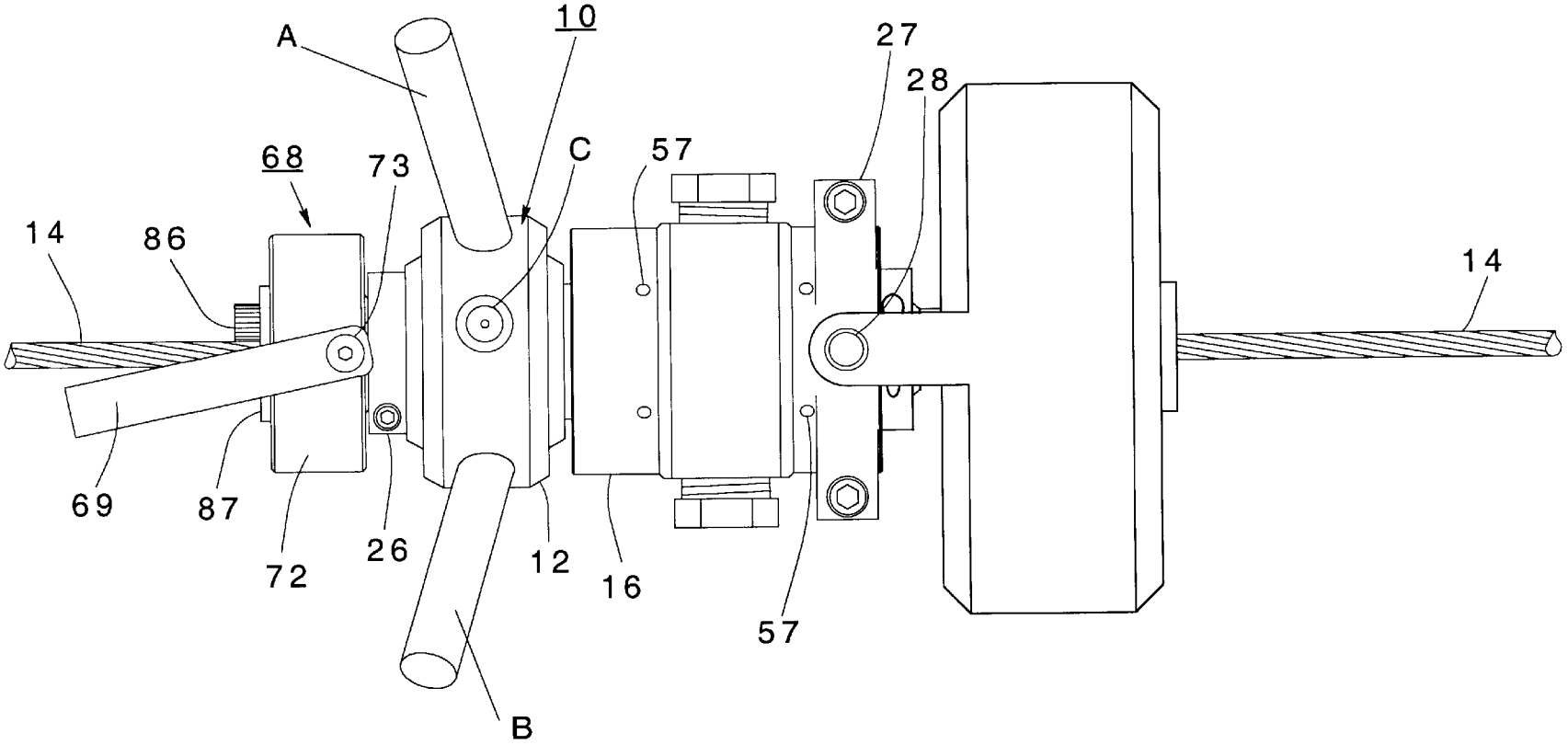
FIG. 8 is a side view similar to FIG. 1 of an alternative embodiment of a cable carried rotary nozzle assembly in which nozzle rotation is achieved by reaction of liquid jet streams from the nozzles and which includes in the assembly a speed controlling retarding mechanism to limit nozzle rotation speed.

FIG. 8 shows an embodiment of the invention using a retarder mechanism 96 having a central rotatable shaft 97 encircling the cable 14 and keyed to the shaft 22 of the subassembly of FIG. 3, A housing 98 of the retarder mechanism 96 is kept stationary relative to the input body member 16 by means of a projection 99 having an aperture through which the pin 28 on ring 27 projects to limit the speed of rotation of the nozzles on the output member when the nozzles are self-rotating in response to reaction forces produced by jet streams from the nozzles.

In the embodiment of FIG. 8, at least some of the pairs of spray nozzles are offset relative to the shaft axis to provide a self-rotating torque to the head 12. Also, at least some of the pairs of spray nozzles may be similarly angled relative to a transverse plane to create a jet reaction force to move the nozzle assembly along the cable support.

The low drag forces achieved with the bearing structure and seals shown in FIG. 3 lend the invention to practical use where the air motor 18 may be eliminated and the output nozzles driven by self rotation forces achieved by appropriate angular orientation of the jet streams flowing from the nozzle tip elements at the ends of the nozzles A—A B—B and C—C.

When the output head 12 is self rotated, the respective mounting, bearing and sealing arrangements of head 12 and input body 16 vis-a-vis the shaft 22 may be reversed so the only the head 12 rotates and the input body 16 is secured to the shaft with the shaft 22 and body 16 remaining non-rotating while the nozzle assemble moves along the cable 14. This can be achieved by connecting input supply hoses to threaded sockets corresponding to sockets 37 and nozzle elements into threaded sockets corresponding to sockets 36.In either case the spray assembly 10 may be moved along the cable 14 by self propulsion due to jet force reaction or by being pulled by the pulling eye assembly of FIG. 5.

All of the components of the jet spray assembly 10 may be readily disassembled for inspection or replacement merely by removing the plate 29, separating the keyed connection between the output member 25 of air motor 18 and shaft 22, loosening and unscrewing one or both of the collars 26 and removing the snap rings 41. The pulling eye assembly can be easily disassembled by unscrewing bolts 73 and 86 and removing the snap ring 78.

Nipples for the pairs of nozzle elements A—A, B—B and C—C may vary in length depending upon the spray cleaning job being performed. The nipples for each nozzle element of a respective pair of elements are of like lengths and angular orientation and the nipples may vary from a few inches to several feet in length. The nozzle elements provide spray jet diameters of the order of one eighth inch. The high pressure liquid is supplied to the nozzle elements at a pressure of 10,000 psi or higher. The flow rate is of the order of 50 gallons per minute per jet stream from each nozzle element. Preferable nozzle rotation speeds may be in the range of 5 to 200 rpm dependent on the geometry and size of the spray assembly.

The cable 14 is of sufficient length to support a spray nozzle assembly weighing about 40 pounds in addition to portions of the cleaning liquid hoses and power hoses or electrical cables necessary to supply cleaning liquid to the jet nozzles and power to any motor being used. Cable length will vary with various applications and may be as long as 200 or so feet with hoses and cables also carried by appropriate hangers carried by the support cable 14. Prior to anchoring the ends of the cable where the spray cleaning is to take place, one end of the cable is threaded through the shaft 22 and the central passage of whatever drive motor or nozzle speed retarder is being used.

Whether the invention is used as in FIG. 3 with a rotating shaft or with a non-rotating shaft, as when the spray head may be self-rotating, the passage which carries the cable support may be eccentrically located toward one side of the shaft, but still isolated from the liquid flow path through one or more other liquid passages between the two plenum chambers.

Figure 9:
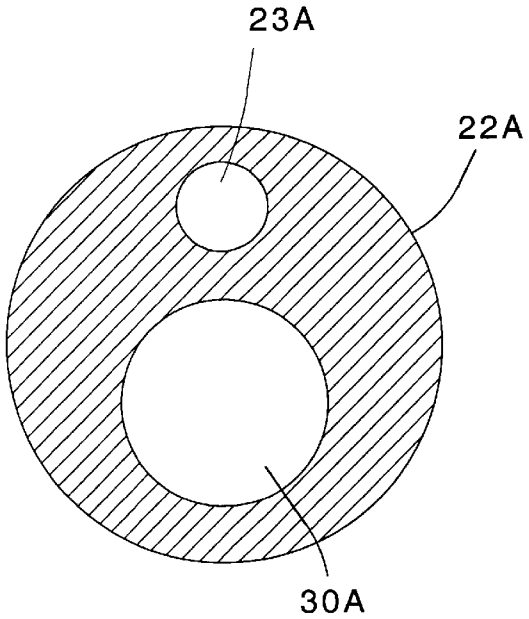
FIG. 9 is a section of an alternative shaft configuration with eccentric cable passage.

FIG. 9 illustrates a modification of the invention which can be used with any of the other described embodiments. In FIG. 9 the shaft, now designated as shaft 22A, has an eccentric bore passage 23A to pass the cable support 14 and a relatively larger passage 30A to provide a flow path between the plenum chambers 19 and 20. Appropriate lateral port means like radial passages 35 connect passage 30A with the respective plenum chambers.

Figure 10:
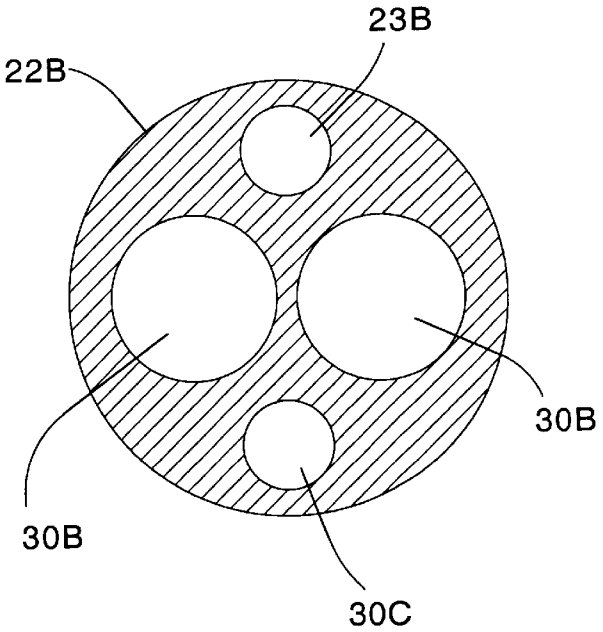
FIG. 10 is a section of another shaft configuration with eccentric cable passage.

FIG. 10 illustrates a modification of the invention which can be used with any of the other described embodiments. In FIG. 10 the shaft, now designated as shaft 22B, has an eccentric bore passage 23B to pass the cable support 14 and multiple other different sized passages 30B and 30C to provide a flow path between the plenum chambers 19 and 20. Appropriate lateral port means like radial passages 35 connect passage 30B and 30C with the respective plenum chambers.

Use of the eccentric cable passages as shown allows the total crosssectional area of the fluid passages to be maximized for high volume fluid flow.

Other variations within the scope of this invention will be apparent from the above described embodiment and it is intended that the present descriptions be merely illustrative of the inventive features encompassed by the appended claims.

What is claimed is:

1. A high pressure liquid swivel nozzle assembly adapted for sliding movement along a small diameter elongated support and for spraying multiple high velocity liquid streams outwardly in continuously changing directions relative to the support and comprising:

a relatively stationary liquid input body member, a rotatable output liquid spray head member, an elongated shaft having a longitudinal axis and connected to said body member and to said head member, said shaft having a central axial passage for passing said support, said shaft having internal liquid passage means extending longitudinally within the shaft in isolated relationship to said central axial passage, each member encircling said shaft and including means sealed with respect to the shaft for defining with the shaft a respective annular plenum chamber around the shaft with each plenum chamber communicating with said passage means to enable flow of high pressure liquid from said body member to said head member, bearing means connected between said shaft and one of said members at each side of the respective plenum chamber to enable relative rotation between said shaft and said one member, means for securing the other of said members relative to said shaft, means for coupling a high pressure liquid source to said input body member, nozzle elements carried by said head member for creating said multiple high velocity streams when high pressure liquid is supplied to said body member, means for rotating said spray head member relative to said input body member to continuously change the directions of said streams during operation of the nozzle assembly, means for preventing rotation of said liquid input body member relative to said support during operational movement of the swivel assembly along the support, sealing means forming a dynamic seal between said shaft and said one member to prevent escape of high pressure liquid from the plenum chamber at said one member, said sealing means comprising at each end of the plenum chamber at said one member an axially extending stack including an outer shaft-encircling annular sealing ring secured to and sealed with respect to said shaft, an intermediate shaft-encircling wear resistant sealing disk and an inner shaft-encircling deformable annular sealing element, said sealing rings being between said bearing means, sealed with respect to said shaft and having flat annular faces orientated toward the respective plenum chamber, said one member having inner annular faces opposite the flat annular faces of the sealing rings to define a pair of annular recesses for retaining said disks and said sealing elements in stacked pairs with the wear resistant disks abutting said flat annular faces of said sealing rings, said one member having at each end of the respective plenum chamber a radially inwardly facing annular wall closely encircling said sealing element and said sealing disk, each said sealing element being subject to high pressure liquid in the respective plenum chamber to press said sealing element and said disk together in a respective stack and against the respective sealing ring face and to radially expand the sealing element outwardly to press against said annular wall to provide means forming a high pressure liquid seal between the sealing element and said wall and between the sealing element and said disk to prevent escape of high pressure liquid from said plenum chamber at said one member.

2. A high pressure liquid swivel nozzle assembly according to claim 1 wherein said one member is the input body member.

3. A high pressure liquid swivel nozzle assembly according to claim 1 wherein said means for rotating said head member relative to said body member is a rotational speed controlling motor means connected between said members.

4. A high pressure liquid swivel nozzle assembly according to claim 3 wherein said shaft has an extension and including means connecting said shaft extension to said motor means to rotate said shaft.

5. A high pressure liquid swivel nozzle assembly according to claim 4 wherein said motor means is a fluid operated motor means.

6. A high pressure liquid swivel nozzle assembly according to claim 4 wherein said motor means is a hydraulic motor means.

7. A high pressure liquid swivel nozzle assembly according to claim 1 wherein said means for rotating said head member relative to said body member is an arrangement of nozzles in said spray head member providing self-rotation of said spray head member by reaction forces from streams from said nozzles.

8. A high pressure liquid swivel nozzle assembly according to claim 7 and further including rotation retarding means connected between said members to limit relative rotational speed therebetween.

9. A high pressure liquid swivel nozzle assembly according to claim 1 wherein said bearing means includes a set of radial ball bearings between said shaft and said one member at opposite sides of the respective plenum chamber.

10. A high pressure liquid swivel nozzle assembly adapted for sliding movement along a small diameter elongated support and for spraying multiple high velocity liquid streams outwardly in continuously changing directions relative to the support and comprising:

a relatively stationary liquid input body member, a rotatable output liquid spray head member, an elongated shaft having a monolithic structure connected to said body member and to said head member and having means defining a longitudinally extending liquid flow path within said shaft between said body and head members, each member encircling said monolithic shaft structure and including means sealed with respect to the monolithic shaft structure for defining with the shaft structure a respective annular plenum chamber around the shaft structure with each plenum chamber communicating with said liquid flow path to enable flow of high pressure liquid from said body member to said head member, the means for defining said liquid flow path in said shaft including at least one longitudinally extending internal passage having an external wall with lateral port means in said wall for providing liquid flow between the passage and the respective plenum chambers and further including means for sealing the opposite ends of each liquid passage beyond its respective lateral port means, said monolithic shaft structure having a longitudinally extending passage with an external wall and open at both ends for passing said support, the walls of said liquid and elongated support passages being laterally connected to each other as part of the monolithic shaft structure along the portion of said shaft between said plenum chambers, bearing means for rotatably supporting one of said members relative to said shaft structure, means for securing the other of said members relative to said shaft structure, means for coupling a high pressure liquid source to said body member, nozzle elements carried by said head member for creating said multiple high velocity streams when high pressure liquid is supplied to said body member, means for rotating said head member relative to said body member to continuously change the directions of said streams during operation of the nozzle assembly, means for preventing rotation of said liquid input body member relative to said support during operational movement of the swivel assembly along the support, sealing means forming a dynamic high pressure liquid seal between said shaft structure and said one member to prevent escape of high pressure liquid from the plenum chamber at said one member.

11. A high pressure liquid swivel nozzle assembly according to claim 10 wherein said longitudinally extending passage for said support is located eccentrically toward one side of the shaft.

12. A high pressure liquid swivel nozzle assembly according to claim 10 wherein there are several internal liquid passages within the shaft structure formed by bores parallel to the center of the shaft with said lateral port means being near opposite ends of each bore to connect said bores to respective plenum chambers.

13. A high pressure liquid swivel nozzle assembly according to claim 12 wherein each said bore has an exposed end at an end of said shaft structure, each said exposed end being sealed by a plug means.

14. A high pressure liquid swivel nozzle assembly according to claim 13 including a swivelled pulling eye means secured to one end of said shaft structure for attachment of a line to move the swivel nozzle assembly along said support while said shaft structure is rotating without rotating said line.

15. A high pressure liquid swivel nozzle assembly according to claim 10 including a pulling eye means secured directly to one end of said shaft structure for attachment of a line to move the swivel nozzle assembly along said support.

16. A high pressure liquid swivel assembly comprising:

a liquid transfer input member, a liquid transfer output member, a shaft having a longitudinal axis and having internal liquid passage means extending longitudinally within the shaft, each member having a liquid passage connection to the internal liquid passage means of said shaft and including means sealed with respect to the shaft for defining with the shaft a high pressure liquid flow path from said input member through said internal liquid passage means to said output member, means for coupling a high pressure liquid source to said input member, one of said members encircling said shaft, bearing means for rotatably supporting said one of said members for rotation relative to said shaft, said one member including means defining with the shaft an annular plenum chamber around said shaft communicating with said internal liquid passage means, sealing means at each end of said plenum chamber comprising an axially extending stack at each end of the plenum chamber including an outer shaft-encircling annular ring secured to and sealed with respect to said shaft, an intermediate shaft-encircling wear resistant sealing disk and an inner shaft-encircling deformable annular sealing element, said rings having flat annular faces orientated toward the plenum chamber, said one member having at each end of the plenum chamber a radially inwardly facing annular wall closely encircling said sealing element and said sealing disk, each said sealing element being subject to high pressure liquid in said plenum chamber to press said sealing element and said disk together in a respective stack and against the respective sealing ring face and to radially expand the sealing element outwardly to press against said annular wall to form a high pressure liquid sealing means between the sealing element and said wall and between the sealing element and said disk to prevent escape of high pressure liquid from said plenum chamber at said one member.

17. A high pressure liquid swivel assembly according to claim 16 wherein each said disk is a carbide disk.

18. A high pressure liquid swivel assembly according to claim 16 wherein each said sealing element is a tough durable plastic element.

19. A high pressure liquid swivel assembly according to claim 16 wherein said one member is the input member.

20. A high pressure liquid swivel assembly according to claim 16 wherein said output member is rotatable and includes nozzle means for spraying rotating high velocity liquid jet streams from said swivel assembly.

21. A high pressure liquid swivel assembly according to claim 16 wherein said output member is rotatable and includes nozzle means for spraying high velocity liquid from said swivel assembly and including means responsive to reaction forces from jet streams from said nozzle means to rotate said output member relative to said input member.

* * * * *